US006725886B2

(12) United States Patent
Dejaegere et al.

(10) Patent No.: US 6,725,886 B2
(45) Date of Patent: Apr. 27, 2004

(54) DEVICE FOR PRESENTING WEFT YARNS ON A RAPIER WEAVING MACHINE

(76) Inventors: Ferdi Dejaegere, Tulpenlaan 8, Dadizele B-8890 (BE); Johny Debaes, Diepestraat 5, Moorslede B-8890 (BE)

( * ) Notice: Subject to any disclaimer, the term of this patent is extended or adjusted under 35 U.S.C. 154(b) by 169 days.

(21) Appl. No.: 10/126,945

(22) Filed: Apr. 22, 2002

(65) Prior Publication Data

US 2002/0166602 A1 Nov. 14, 2002

(30) Foreign Application Priority Data

Apr. 20, 2001 (BE) ..... 2001/0276

(51) Int. Cl.[7] ..... D03D 47/38
(52) U.S. Cl. ..... 139/453
(58) Field of Search ..... 139/450, 452, 139/453, 449, 438, 447, 116.1

(56) References Cited

U.S. PATENT DOCUMENTS

| | | | | |
|---|---|---|---|---|
| 3,542,085 A | * | 11/1970 | Haltmeier | 139/453 |
| 3,941,158 A | * | 3/1976 | Joans | 139/453 |
| 5,694,982 A | * | 12/1997 | Debaes | 139/453 |
| 6,308,743 B1 | * | 10/2001 | Debaes et al. | 139/450 |

FOREIGN PATENT DOCUMENTS

| | | |
|---|---|---|
| DE | 2258597 | 6/1974 |
| DE | 4446290 | 6/1995 |
| EP | 0644285 | 3/1995 |
| EP | 0902109 | 3/1999 |

* cited by examiner

*Primary Examiner*—Danny Worrell

(57) ABSTRACT

A device for presenting weft yarns (1), (2) to two (or more) rapiers provided above one another of a weaving machine, comprising two yarn carriers (14), which are movable between a receiving position, in which each yarn carrier (14) is able to receive a respective weft yarn (1), (2) to carry along this yarn, and a presenting position in which each yarn carrier (14) is able to present a weft yarn (1), (2) carried along to a respective rapier in order to insert this yarn into a shed. The presenting arms (3), (4) are rotatable above one another in respective intersecting planes of movement. Preferably, the upper presenting arm (3) is rotatable in a horizontal plane of movement, while the lower presenting arm (4) is rotatable in a plane of movement that is inclined downwards in the direction of the presenting position. With a similar presenting device the weft yarns can be taken up very close to the fell of the fabric and cut through, waste selvedges becoming unnecessary and weft yarns can be saved. This device functions well at high weaving machine speeds.

12 Claims, 3 Drawing Sheets

DEVICE FOR PRESENTING WEFT YARNS ON A RAPIER WEAVING MACHINE

This application claims the benefit of Belgian Application No. 2001/0276 filed Apr. 20, 2001.

BACKGROUND OF THE INVENTION

This invention relates to a device for presenting weft yarns to two rapiers provided above one another of a rapier weaving machine, comprising two yarn carriers, which are movable between a receiving position in which they are able to receive a respective weft yarn to carry along this yarn and a presenting position in which they are able to present a yarn carried along to a respective rapier to insert this yarn into the shed.

After having inserted two weft yarns into a shed between the warp yarns of a rapier weaving machine the inserted weft yarns are beaten up by the weaving reed. The weft yarns are then cut through along the selvedge of the fabric, so that the weft yarns supplied will obtain free ends. During a next yarn weft, each rapier must be able to insert a new piece of weft yarn into the shed, and therefore the free weft yarns must be taken up at the selvedge of the fabric after each weft and presented to the rapiers for a next weft.

More particularly, this invention relates to a device for taking up the two free weft yarns at the selvedge of the fabric and for presenting them for a next weft, after the beating up of the weaving reed and after cutting off the inserted pieces of weft yarn. More particularly this invention relates to such a device that at the same time provides for automatic gripping, cutting off and presenting two weft yarns to the rapiers.

In the Belgian patent disclosure BE 1 008 211 a similar device has been described. This device is provided for successively gripping, cutting off and presenting to an upper and a lower rapier two weft yarns that were inserted into a fabric on a double rapier weaving machine. When the weaving reed starts beating up, the inserted weft yarns are well spread by means of weft separation plates and inserted into the respective opened weft cutter-gripping combinations. After cutting through the weft yarns, relatively long weft yarn ends will appear at the selvedges of the fabric when using this device. In order to remove these long yarn ends, additional waste selvedges are provided along the selvedges of the fabric. Thereafter, these waste selvedges are cut off and removed. This is a cause for waste of weft and warp yarn material. This weft presenting device is attached to the weaving batten, and therefore moves together with the weaving batten, so that the inertia of this device causes additional inertial forces on the weaving batten. This is especially harmful at high weaving machine speeds.

Another device for gripping, cutting off weft yarns and presenting them to the rapiers situated above one another of double rapier weaving machines is described in DE AS 2 258 597. This device is not installed on the weaving batten, but has likewise the disadvantage of producing relatively long weft yarn ends at the selvedges of the fabric and likewise requires the use of waste selvedges. Moreover, the drive with open cam system and resetting force by means of a retracting spring prevents the weaving machines from reaching high speeds.

SUMMARY OF THE INVENTION

The purpose of the present invention is to provide a device for presenting weft yarns to two rapiers situated above one another of a rapier weaving machine, by means of which the above-mentioned disadvantages are remedied.

More specifically, the present invention aims at providing a device with which the weft yarns may be taken up and cut off as close to the selvedge of the fabric as possible, in order to obtain weft yarn ends which are notably shorter than when using the known devices (so that the use of waste selvedges is no longer required), and with which the yarns that are cut off may then be presented to two rapiers situated above one another.

This purpose is attained by providing a device for presenting weft yarns to two rapiers provided above one another of a rapier weaving machine, comprising two yarn carriers that are movable between a receiving position in which they are able to receive a respective weft yarn in order to carry along this yarn and a presenting position in which they are able to present a weft yarn carried along to a respective rapier to insert this weft yarn into a shed, each yarn carrier being carried by a respective presenting arm and these two presenting arms being rotatable above one another in respective intersecting planes of movement.

Because the two planes of movement of the rotatable presenting arms are no parallel planes, but intersecting planes, the yarn carriers in the receiving position can be situated above one another at a limited distance and being rotated, moving away from each other, towards the presenting position, so that in that presenting position they reach a vertical intermediate distance corresponding to the difference in height between the two rapier levels. Because of this, the yarn carriers can reach the fell of the fabric at a short distance above one another and the weft yarns can be gripped at a height, which is only slightly different from the height at which they extend in the fabric. Because of this, spreading the weft yarns well is not needed. Because of this limited spreading the yarn end between the selvedge of the fabric and the weft cutter can be particularly short. In other words, the weft yarns can be cut off very short at the selvedge of the fabric and thus very short weft yarn ends can be obtained and the use of waste selvedges can be avoided.

In a preferred embodiment the upper presenting arm is rotatable in a practically horizontal plane of movement, whereas the lower presenting arm is rotatable in plane of movement inclined downwards in the direction of the presenting position. When the lower presenting arm rotates towards the position in which the yarn carrier comes in its presenting position (in the following this is called the presenting position of the presenting arm) the yarn carrier moves, slanting downwards, until just below the level of movement of the lower rapier in order to present the lower weft yarn in a very efficient manner to this lower rapier. The upper presenting arm can stay in a same horizontal plane, which extends just below the level of movement of the upper rapier, in order to present the weft yarn in a very efficient manner to the upper rapier. Of course, other arrangements are also possible, for instance an arrangement in which the plane of movement of the lower presenting arm is practically horizontal and the plane of movement of the upper rapier is inclined upwards in the direction of the presenting position, or an arrangement in which the planes of movement of the upper and lower presenting arms are inclined upwards and downwards respectively in the direction of the presenting position.

In a particular embodiment, the two presenting arms are attached rotatably to a vertical shaft, while at least one of the presenting arms is attached to this shaft by means of a bearing with a rotation plane that is inclined upwards or downwards to the presenting position.

In a particularly advantageous embodiment the presenting arm comprises a yarn guiding means for a weft yarn, which is provided at a higher level than the yarn carrier, so that each presenting arm can be brought into a position in which the yarn carrier keeps a weft yarn, carried along, below the carrying level of a rapier, while the yarn guiding means keeps the weft yarn, carried along, above this carrying level. In a similar manner, presented weft yarns may be easily and impeccably carried along by the rapiers. The rapier head can move between the upper feed-through eye and the lower yarn carrier to take up the weft yarns by means of the rapier head when the presenting arm has taken up its presenting position.

If the yarn guiding means of each presenting arm is provided on the presenting arm, the advantage is obtained that the feed-through eyes remain at a constant distance from the weft yarn grippers during the rotating movement, because of which the weft yarns presented always remain tightened and the weft yarns can be taken up well by the rapier heads.

In another preferred embodiment the device comprises a separating body with separating means to keep separated two weft yarns inserted into a fabric above one another at the fell of the fabric, while the separating body comprises a first part, in essence, running in the warp direction, which is connected to the separating means via a second part approaching the fell of the fabric in the direction of the separating means, so that the separating means are situated closer to the fell of the fabric than the first part of the separating body.

A similar separating body leaves open a free space next to the first part on the side directed towards the fabric, while the separating means may be situated very close to the fell of the fabric and will leave space for the yarn carriers. In an advantageous manner, this space can be occupied by other parts of the device of the weaving machine. Preferably, the position of the separating body is also adjustable.

A very suitable device is obtained by providing a weft cutter to cut through the said weft yarns, so that this weft cutter, in essence, is situated next to the first part of the separating body on the side directed towards the fabric. Thus, the weft cutter can be situated very close to the selvedge of the fabric in order to cut through the weft yarns as close as possible to the selvedge.

Preferably, the yarn carriers mentioned above are carried out as gripping devices, which may be brought into an open or a closed situation by an actuator.

The device functions very well when the yarn carriers can be positioned in their receiving position such, that two weft yarns inserted into the fabric above one another are brought into an opened yarn carrier by the beating up of the weaving reed.

It is further also preferable to carry out the device with a module made in one piece, which comprises one or more of the following components: a separating body in order to keep separated at the fell of the fabric two weft yarns inserted into the fabric above one another, a weft cutter for cutting through the weft yarns along the fell of the fabric, an upper and a lower yarn carrier on a respective rotatable presenting arm in order to present the weft yarns, after they have been cut through, to respective rapiers, and driving means for the device.

The said driving means can be comprised in a casing, which is a part of the said module, this casing functioning as a carrier for the various components of the module.

When the said module is movable and adjustable in the weft direction, the great advantage is obtained that the adjusted synchronizations and positions can be maintained when adjusting the weaving width or when making any adjustments in the weft direction. Adjusting can be achieved in one single operation for all components being part of the module.

The said module can also be connected to a temple device, the position of which is adjustable in the weft direction, the connection being realized with the help of a coupling means, by means of which the mutual distance in the weft direction between the temple device and the said module is adjustable. Such an adjustable coupling means is, for instance, a spindle adjusting screw.

By coupling the temple plates with their holder to the module of the weft yarn presentation, the temple holders will be prevented from hurting the weft cutter when adjusting the temple width. When adjusting the temples widthways the adjusted minimum mutual distance between weft cutter and temple holder plate can also be maintained. Adjusting the temples widthways and adjusting the weft presentation may be done in one operation. To that effect, the weft presenting module and the holder of the temple device are, for instance, connected to one another by means of a spindle screw with left-hand and right-hand thread. The mutual distance between temple device and weft presenting module can be adjusted with precision and can also be maintained. Because of this adjusting widthways becomes less time-consuming and possible damage to the weft cutter will be avoided.

These and other characteristics of the device according to the present invention are clarified and illustrated in the more detailed description of a possible embodiment following below.

It may be clear that the only purpose of this description is to clarify the invention with the help of some examples and therefore in no way may be considered as a limitation of the scope of this patent protection, such as it will be determined in the attached claims.

In this description reference is made by means of reference numbers to the attached drawings, of which:

DETAILED DESCRIPTION OF THE PREFERRED EMBODIMENTS

Figure 1:
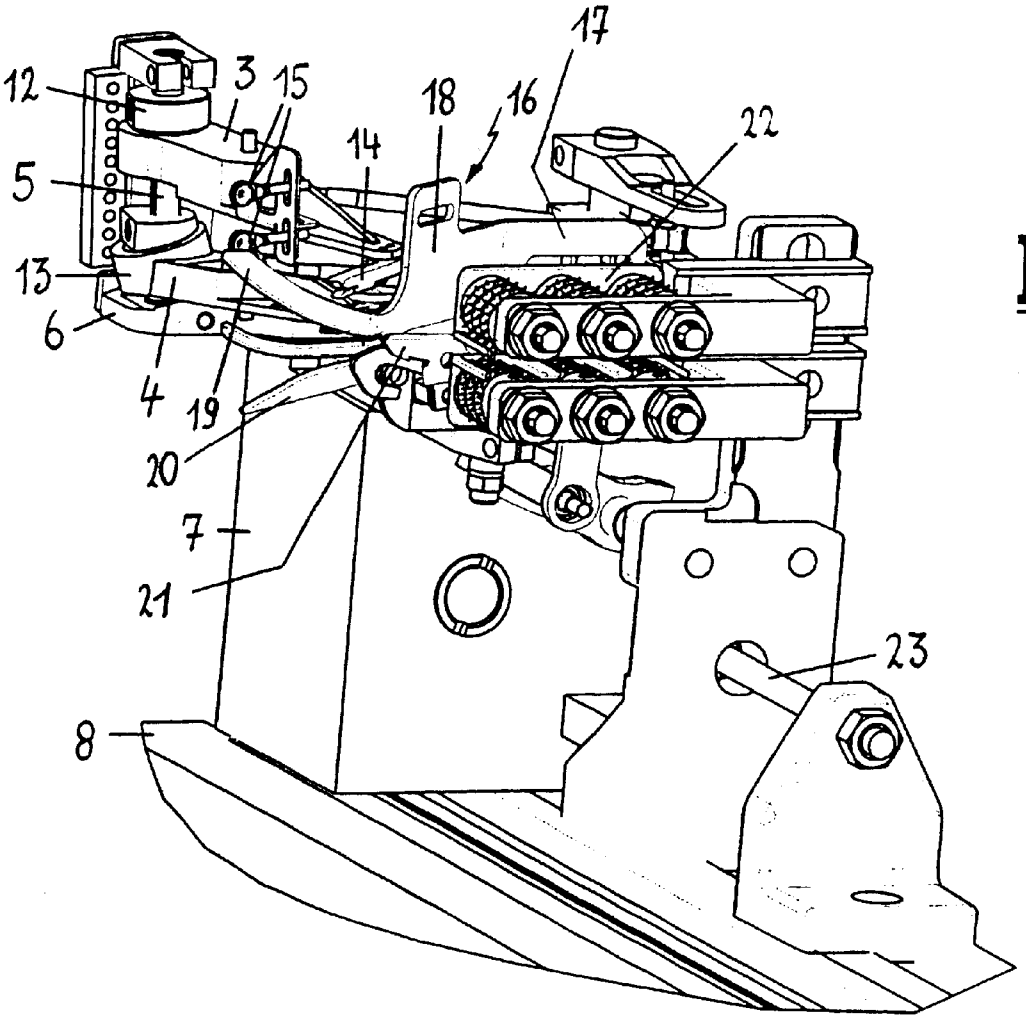
FIG. 1 is a perspective view, seen from the side on the fabric side, of a weft presenting device according to the present invention, installed on a double rapier weaving machine, FIG. 2 another perspective view of the device of FIG. 1, seen from the back and represented during the weaving process on the weaving machine.

A possible embodiment of the device for presenting weft yarns (1), (2) according to the present invention comprises an upper (3) and a lower presenting arm (4), which each separately, are rotatably attached to a vertical bearing shaft (5), which is kept in a holder (6). The holder (6) is attached to a casing (7) for the driving means of the device. This casing (7) is installed next to the fabric selvedge on the front traverse (8) of a double rapier weaving machine and is adjustably attached in a T-shaped groove extending in the weft direction.

Figure 2:
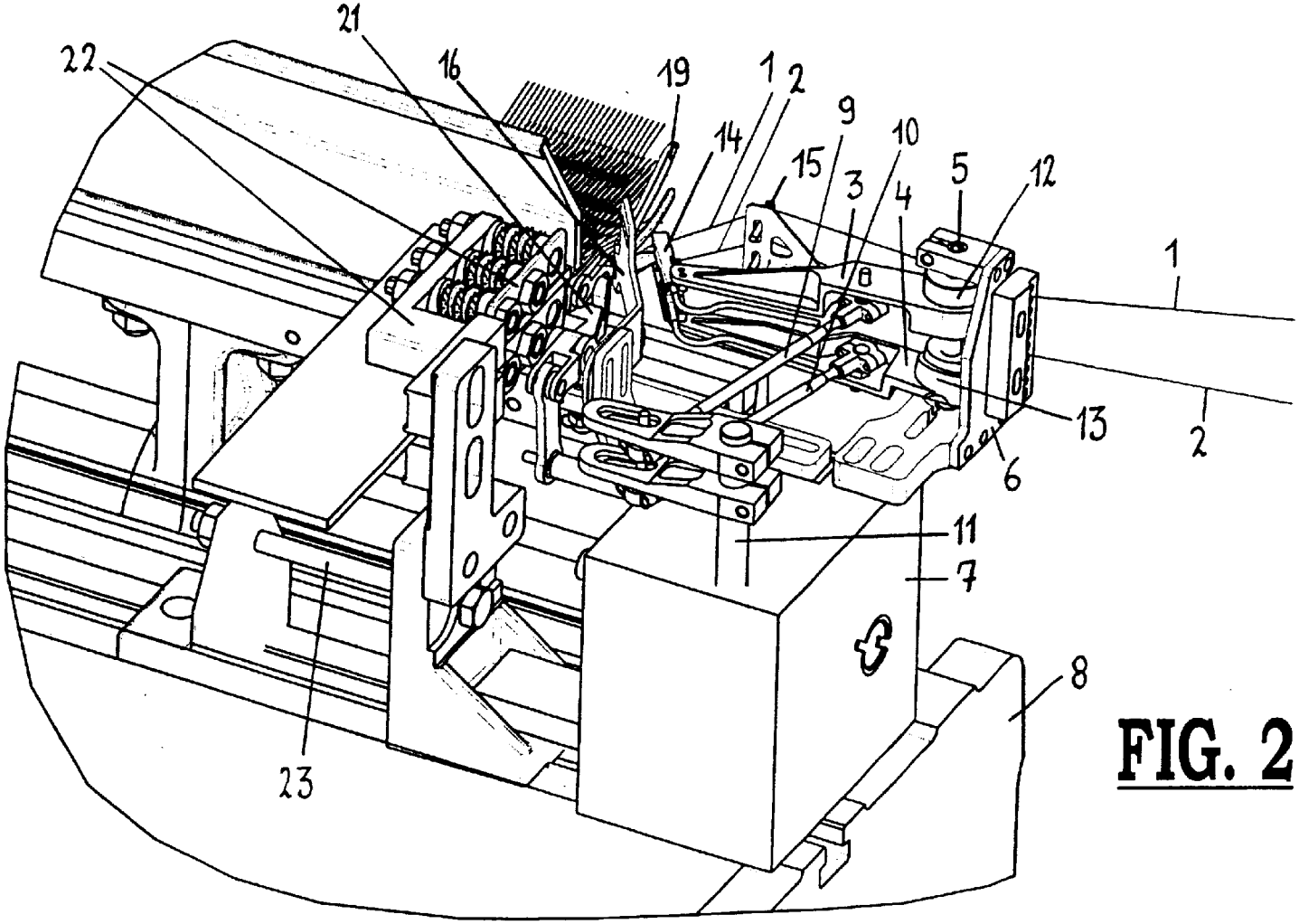

Each presenting arm (3), (4) is rotatable around the bearing shaft (5) by means of a respective driving rod (9), (10), connecting the presenting arm (3), (4) to a driving shaft (11) extending from the casing (7). The driving means for the presenting arms (3), (4) are provided in this casing (7). The upper presenting arm (3) is attached to the vertical bearing shaft (5) by means of a bearing (12) with a horizontal rotation plane, so that the upper presenting arm (3) is rotatable in a horizontal plane of movement. The lower presenting arm (4) is attached to the vertical bearing shaft (5) by means of a bearing (13) with inclined plane of rotation, so that this lower presenting arm (4) is rotatable in a plane of movement that, towards the front (to the left in FIG. 1 and upwards in FIG. 2) is inclined downwards.

Each presenting arm (3), (4) at the end, directed towards the fabric, is provided with a weft yarn gripper (14), which by means of an actuator, may be put in an opened or in a closed position. The actuator may be any electric, electromagnetic, pneumatic or hydraulic driving system.

On each presenting arm (3), (4) also a feed-through eye (15) is provided. This feed-through eye (15) is situated at a higher level than the weft yarn gripper (14). Because of this the weft yarns are presented to the rapiers in a very efficient manner. Because the feed-through eyes (15) are situated on the presenting arms (3), (4), these feed-through eyes (15) always remain at a constant distance from the weft yarn grippers (14) during the rotating movement of the presenting arms (3), (4). The presented weft yarns (1), (2) always remain tightened, so that they may be well taken along by the rapier heads.

The device further comprises also a separating plate (16), with a plate-shaped part (17, 18), which is installed in a primarily vertical position, and which ends at the front with two spreading fingers (19), (20) extending above one another in the warp direction next to the selvedge of the fabric. The upper (19) and the lower spreading finger (20) are moving away from one another towards their extremities and are directed upwards and downwards respectively. The plate-shaped part (17, 18) has a first part (17) that extends in the warp direction and a second part (18) linked up to it, slanting towards the fabric, so that the spreading fingers (19), (20), fitting to this second part (18), extend again in the warp direction next to the selvedge of the fabric in a plane that is situated closer to the selvedge of the fabric than the plane in which the first plate-shaped part (17) extends. The separating plate (16) at the first part (17) is attached to the above-mentioned casing (7) in an adjustable manner.

The separating plate (16) is provided to keep the two weft yarns (1), (2) separated at a short distance above one another by means of the spreading fingers (19), (20).

Figure 3:
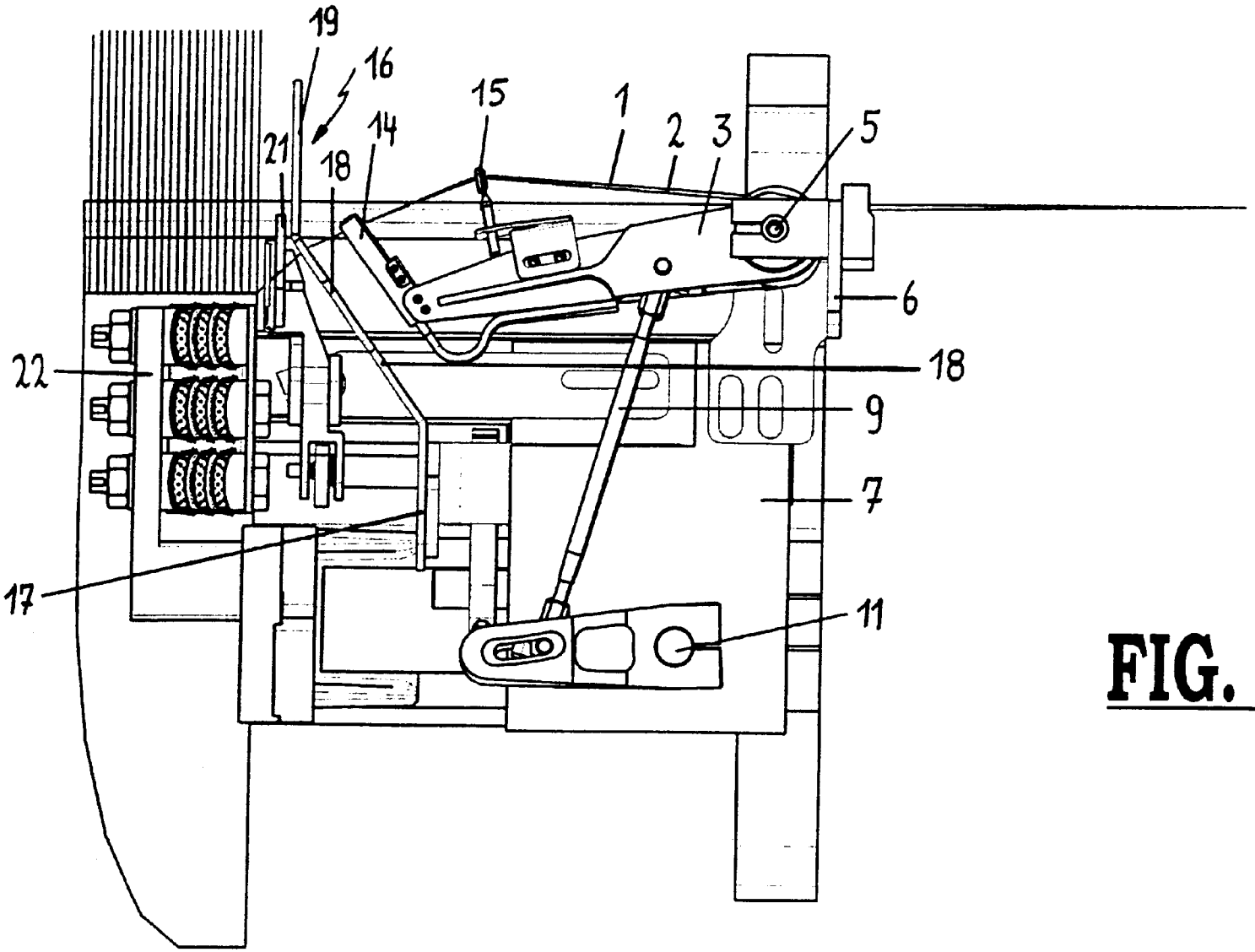
FIG. 3 represents a top view of that represented in the FIGS. 1 and 2.

In the figures, the presenting arms (3), (4) are represented in a receiving position. When they are placed in an opened position by the control system, the two weft yarns (1), (2) inserted above one another are pushed forward in the fabric (in FIG. 3 downwards) by the beating up movement of the weaving reed. Thus, these yarns (1), (2) will get into the opened yarn grippers (14) on the side of the selvedge of the fabric. Then the yarn grippers (14) are closed.

Then the two weft yarns (1), (2) are cut through by a weft cutter (21), installed on the other side of the separating plate (16). Because of this, the weft yarns are cut off very close to the selvedges of the fabric with a common weft cutter (21) for the upper and lower cloth. The weft cutter (21) is mounted on a lever (22), which is hingedly attached to a holder that is connected to the drive casing (7). In this drive casing (7), driving means for the weft cutter (21) are also provided.

The weft separating plate (16) with spreading fingers (19), (20) is suitably carried out with a part (18) slanting towards the fabric, to make space for the weft cutter (21) that must cut off the weft yarns (1), (2) immediately next to the temple holder (22).

By a forward rotation (upwards in FIG. 3) of the presenting arms (3), (4) the yarn grippers (14) are brought into a presenting position, in which they are able to present the two weft threads to a respective rapier. The rapiers of the weaving machine provided above one another are not represented in the figures.

The vertical bearing shaft (5) for the rotatable presenting arms (3), (4) is likewise attached to the drive casing (7). The upper presenting arm (3) rotates with the yarn gripper (14) provided on it in a practically horizontal plane situated just below the upper rapier and with the feed-through eye (15) provided on it in a plane that is situated above this upper rapier.

The lower presenting arm (4) rotates in a plane inclined downwards in the direction of the presenting position, in such a manner that the weft yarn gripper (14) with the weft yarn (2) dives under the rapier head into the presenting position and the corresponding feed-through eye (15) is brought just above the lower rapier head. The rotating movement in an inclined plane is obtained by providing a slanting bearing on the vertical bearing shaft (5).

Because of the rotating movement in an inclined plane, the yarns which are picked up by the yarn grippers (14) in the presenting position at a short distance above one another, are moved away from one another during the rotation towards the presenting position, up to a distance practically corresponding with the distance between the rapier heads situated above one another, so that each weft yarn (1), (2) in the presenting position is presented just below its respective rapier head.

By providing the presenting levers with feed-through eyes (15) for the weft yarns (1), (2) and by placing those feed-through eyes (15) at a height above the yarn gripper (14), each rapier head can move, with respect to a respective presenting arm (3), (4) brought into the presenting position, between the upper feed-through eye (15) lying above and the yarn gripper (14) lying below, to pick up a weft yarn (1), (2) in a very efficient manner.

The weft cutter (21), the weft separating plate (16), the presenting arms (3), (4) and the driving means of the device are built as a whole in a module. Because of this, the mutual synchronizations and positions can be maintained when adjusting the weaving width or when adjusting the position in the weft direction. Adjusting widthways may be done in a simple manner by attaching it, in a manner movable in the weft direction, to the front traverse (8) by means of a tooth-and-slot connection.

In order to avoid, that when adjusting the temple width, the temple holders (22) might hit the weft cutter (21), the temple plates with their holders are preferably coupled to the drive casing (7) by means of a spindle adjusting screw (23), so that when adjusting the temples widthways, the minimum mutual distance between weft cutter (21) and temple holder (22) is maintained. Therefore adjusting the temples widthways and adjusting the weft presenting device can be done in one single operation. To that effect the casing (7) of the presenting device and the holder (22) of the temple device are connected to a spindle screw (23) with a left-hand and a right-hand thread by means of which the mutual distance can be adjusted with great precision and also maintained. Because of this adjusting widthways becomes less time-consuming and possible damage to the weft cutter (21) is avoided.

With this device, waste selvedges on the weft presenting side are made unnecessary and it is possible to save weft yarns and warp yarns for tucking ribbons. Moreover, this device functions very well at high weaving machine speeds.

It is an understood thing that according to the present invention also weft presenting devices can be built with more than two presenting arms to present the weft yarns to the respective rapiers of weaving machines with more than two rapier devices functioning above one another. Similar devices are also within the scope of this patent protection.

What is claimed is:

1. Device for presenting weft yarns to two rapiers provided above one another of a rapier weaving machine, comprising two yarn carriers, which are movable between a receiving position in which they are able to receive a respective weft yarn in order to take along this weft yarn, and a presenting position in which they are able to present a weft yarn taken along to a respective rapier, in order to insert this weft yarn into a shed, wherein each yarn carrier is carried by a respective presenting arm and wherein these two presenting arms are rotatable above one another in respective intersecting planes of movement.

2. Device for presenting weft yarns according to claim 1, wherein the upper presenting arm is rotatable in a plane of movement that is practically horizontal, and in that the lower presenting arm is rotatable in a plane of movement that is inclined downwards in the direction of the presenting position.

3. Device for presenting weft yarns according to claim 1 wherein the two presenting arms are rotatably attached to a vertical shaft and wherein at least one of the presenting arms is attached to this shaft by means of a bearing having a plane of rotation that is inclined downwards or upwards towards the presenting position.

4. Device for presenting weft yarns according to claim 1, wherein each presenting arm comprises a yarn guiding means for a weft yarn that is provided in a higher position than that of the yarn carrier, so that each presenting arm can be brought into a position in which the yarn carrier keeps a weft yarn below the taking along level of a rapier, while the yarn guiding means keeps the weft yarn taken along, above this taking along level.

5. Device for presenting weft yarns according to claim 1, wherein the device comprises a separating body with separating means in order to keep weft yarns, having been inserted above one another into a fabric, separated from one another at the fell of the fabric, and wherein the separating body comprises a first part, primarily running in the warp direction, that is connected to the separating means via a second part approaching the fell of the fabric in the direction of the separating means, so that the separating means are situated closer to the fell of the fabric than the first part of the separating body.

6. Device for presenting weft yarns according to claim 5, wherein the device comprises a weft cutter in order to cut through the said weft yarns, and wherein the weft cutter is primarily situated next to the said first part of the separating body on its side directed towards the fabric.

7. Device for presenting weft yarns according to claim 1, wherein the yarn carriers are gripping devices, which may be brought into an open and into a closed position by means of an actuator.

8. Device for presenting weft yarns according to claim 7, wherein the yarn carriers, in their receiving position, are positioned in such a manner that two weft threads, inserted above one another into a fabric, are brought into an open yarn carrier by the beating up of the weaving reed.

9. Device for presenting weft yarns according to claim 1, wherein the device comprises a module made of one piece, in which one or more of the following components are incorporated: a separating body in order to keep two warp yarns, having been inserted above one another, separated from one another at the fell of the fabric, a weft cutter for cutting through the weft yarns, an upper and a lower yarn carrier on a respective rotatable presenting arm in order to present the weft yarns, after having them cut through, to a respective rapier, and driving means for the device.

10. Device for presenting weft yarns according to claim 9, wherein the driving means are incorporated in a casing, that is part of the said module, and wherein this casing serves as a carrier for the various components of the module.

11. Device for presenting weft yarns according to claim 9, wherein the said module, as a whole, is movable and adjustable in the weft direction.

12. Device for presenting weft yarns according to claim 11, wherein the said module is connected to a temple device, the position of which is adjustable in the weft direction, by means of a coupling means with which the mutual distance in weft direction is adjustable between the temple device and the said module.

* * * * *